US005351853A

United States Patent [19]

Shock

[11] Patent Number: 5,351,853

[45] Date of Patent: Oct. 4, 1994

[54] BEVERAGE CAN CLOSURE

[76] Inventor: John P. Shock, #1 Oakmont Ct., Little Rock, Ark. 72212

[21] Appl. No.: 123,242

[22] Filed: Sep. 20, 1993

[51] Int. Cl.[5] ..... A47G 19/22

[52] U.S. Cl. ..... 220/729; 220/258; 220/259

[58] Field of Search ..... 220/258, 259, 269, 307, 220/336, 694, 729, DIG. 19

[56] References Cited

U.S. PATENT DOCUMENTS

| | | | |
|---|---|---|---|
| 3,428,212 | 2/1969 | Rohrlick | 220/307 |
| 4,842,159 | 6/1989 | Heidrich | 220/714 |
| 5,199,591 | 4/1993 | Thibeault et al. | 220/253 |
| 5,285,924 | 2/1994 | Morris | 220/694 |

*Primary Examiner*—Allan N. Shoap
*Assistant Examiner*—Nova Stucker
*Attorney, Agent, or Firm*—Stephen Carver; Trent Keisling

[57] ABSTRACT

A resilient, modular closure for selectively sealing an opening in a pry tab beverage can. The closure comprises a handle perpendicularly extending from an integral body. The handle is grasped between the thumb and the forefinger of the user. The body comprises a downwardly-projecting, beveled offset adapted to mate with the can opening, and a notch adapted to wedgably engage the pry tab. The ventral surface of the body comprises a circumferential ridge adapted to contact a top of a beverage can to seal around the opening or to mate with a reinforcement channel surrounding the can opening. Raised guides are defined along the dorsal surface of the notch for captivating the pry tab during installation of the closure. A snap fit yieldably engages the rim of the can when the closure is installed. The snap fit comprises a rim-receptive slot. A stop extends rearwardly from the body to contact an inner surface of the rim, and an "L" shaped jaw extends downwardly from the handle. A horizontal leg of the jaw catches on the lower outer surface of the rim when the closure is forced downwardly and the can rim enters the slot between the horizontal leg and the stop.

11 Claims, 4 Drawing Sheets

BEVERAGE CAN CLOSURE

BACKGROUND OF THE INVENTION

I. Field of the Invention

The present invention relates generally to beverage can closures. More particularly the present invention relates to modular beverage can closures which directly engage the opening in a conventional beverage can. Art pertinent to the present invention is classified within numerous subclasses in U.S. Patent Class 220.

II. The Prior Art

Conventional pry tab-activated beverage cans typically include a top or end wall employing a score to define an opening. A pry tab is anchored to the top wall of the container by a rivet that defines a leverage point. When that portion of the tab opposite the scored area is raised by the user, the opposite end of the tab contacts and deflects the area circumscribed by the score, rupturing it from the can end. As the pry tab is leveraged about the rivet, the scored end portion is separated from the top and bent downwardly into the can.

Known pry tab cans are not easily resealable. Although plastic tops may be affixed over the can end, they do not offer the same ease of use as other closure devices offer for competing beverage containers. For example, various types of plugging or capping closures are known for resealing bottles. One desiring to use only a portion of the contents of a pry tab container has no known way to avoid loss of carbonation, contamination spilling of the contents of an opened can.

Several attempts have been made to devise pull or pry tabs for beverage cans which are resealable. Among these attempts are Fridi U.S. Pat. No. 4,244,488 and my U.S. Pat. Nos. 5,080,249 and 5,129,773. Such structures require extensive modification to existing can configurations. Therefore, they have proven largely impractical. Hence, it is desirous to provide a closure that can be used by the ultimate consumer.

Numerous attempts have been made to craft a can sealer or closure. Patents related to such devices included U.S. Pat. No. 3,727,787 issued to Gregory on Apr. 17, 1973. This "Pop-Top Can-Resealer" is aimed at older type pull-tab cans which have largely been replaced by the above described pry-tab cans. Another pop-top closure is disclosed in U.S. Pat. No. 3,680,732.

Other known devices cover the entire top of the can. One such device is disclosed in Corey, U.S. Pat. No. 4,913,304, issued Apr. 3, 1990. This device employs a spring to facilitate the engagement of a plastic disc with the rim of a can. A snap on top is disclosed in Taylor, U.S. Pat. No. 4,632,271. A similar device is disclosed in U.S. Pat. No. 3,680,731.

Other devices employ a complete top seal with a portion intended to mate with the opening in the can. One such device is disclosed in Gerien, U.S. Pat. No. 4,703,873, issued Nov. 3, 1987. Gerien also discloses a flip-top to facilitate use. Another U.S. Patent disclosing such a flip-top is U.S. Pat. No. 4,796,774 issued to Nabinger on Jan. 10, 1989.

Pierce, U.S. Pat. No. 4,989,746, discloses a closure system for a container which employs an insert to be mounted to the top of the container and a plug to be mated with the insert. The can on which this closure is intended to be used differs somewhat from the conventional pry-top can. Another can closure is disclosed in U.S. Pat. No. 3,680,729.

Hence, it is desirous to provide a can closure for pry top cans which can be used by the ultimate consumer. This closure should employ existing can components to facilitate its operation. Due to the variations in can end structures from can to can it is necessary that the closure employ elements that allow it to function without dependence on exact clearances and tolerances. In other words the closure needs to seal the opening in the can top regardless of minor variations in its shape or size. Furthermore to make the closure easy to use it needs to employ a relatively large handle or gripping area. To facilitate use further the closure should use structures to assist in guiding it into place on the can.

SUMMARY OF THE INVENTION

My can closure is intended for use by the ultimate consumer of pry-top beverage cans. It will allow a person to reseal a partially consumed pry tab beverage can after it has been pried open. My closure employs the pry tab and can rim to hold itself in place over the can opening. A pair of tongues wedge under the tab and a snap fit engages the rim. The can is sealed by an offset which will mate snugly within the opening. The offset includes a tapered circumferential ridge which adapts it for openings of varying sizes. The closure is manipulated by a relatively large handle providing a convenient gripping area for the thumb and forefinger of one's hand.

My closure is adapted for use with the currently prevalent pry tab cans. As mentioned above it employs elements of the can end construction to facilitate operation. My closure is modular and is preferably constructed of a resilient material such as plastic. Such a material has sufficient "memory" to return to its original shape after being deformed during installation. Yet, the closure must be somewhat pliable to facilitate sealing.

My closure comprises a central body and an integral, perpendicular handle. A front notch in the body clears the pry tab rivet as the body is wedged between the pry tab and the can top. The notch is defined between two forwardly projecting tongues. One passes to each side of the rivet. A snap fit opposite the notch yieldably engages the rim of the can to hold the closure in place. The snap fit comprises a stop extending rearwardly from the body, a rim-receptive slot, and an "L" shaped jaw extending from the handle. When the closure is installed, the stop contacts the inner surface of the rim and the jaw captivates the enlarged portion of the rim.

The ventral surface of the body defines a beveled edged offset intended to mate with the can opening. A circumferential ridge disposed about the offset extends along the ventral side of the tongues. The ridge contacts the can top or mates with a reinforcement channel defined around the opening thereby aiding sealing. Guides are defined in the dorsal surface of the body extending along the outer edges of the tongues. The guides aid in inserting the notch under the tab.

The handle has indented gripper areas defined in its sides to facilitate grasping with the thumb and forefinger of one hand. Alternatively, the handle may be a ring or horizontally oriented pad. Such an alternative handle would require an alternative arrangement of the snap fit. For example, both the stop and the jaw of the snap fit could be integral with the body.

To install my closure one grasps the handle with the thumb and forefinger of one hand while holding the can in the other. The tongues are slipped under the pry tab, and the closure is slid forward until the snap fit stop clears the rim. Then the handle is pushed downwardly snapping the snap-fit over the rim. Removal is simply the reverse. The handle is pulled upwardly, and the closure is slid back, out of engagement with the tab.

Therefore, a primary object of the present invention is to provide a can closure that can be used by the ultimate consumer.

A related object of the present invention is to provide a can closure that utilizes the components of a conventional pry tab can to facilitate sealing the opening in the can.

An object of the present invention is to provide a can closure that will operate on cans with a variety of pry tab can configurations.

A related object of the present invention is to provide a can closure that will seal pry tab can openings of various of shapes and sizes.

A further related object of the present invention is to provide a can closure that will engage a variety of pry tab and rivet configurations.

A further related object of the present invention is to provide a can closure that will snap-fit to a variety of rim configurations.

Another primary object of the present invention is to provide a can closure that is easy and convenient to use.

An object of the present invention is to provide a can closure that employs a relatively large grip to facilitate use.

An object of the present invention is to provide a can closure that employs guides to facilitate installation of the closure.

An object of the present invention is to provide a can closure with a sealing structure on its ventral surface that will accommodate a variety of can top openings.

An object of the present invention is to provide a can closure with a wedge shaped forward notch to facilitate insertion of the notch between the pry-tab and the can top.

An object of the present invention is to provide a can closure that employs ventral structures to mate with various sized can openings and the structures related thereto.

An object of the present invention is to provide a can closure that employs a snap-fit to hold it in place.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
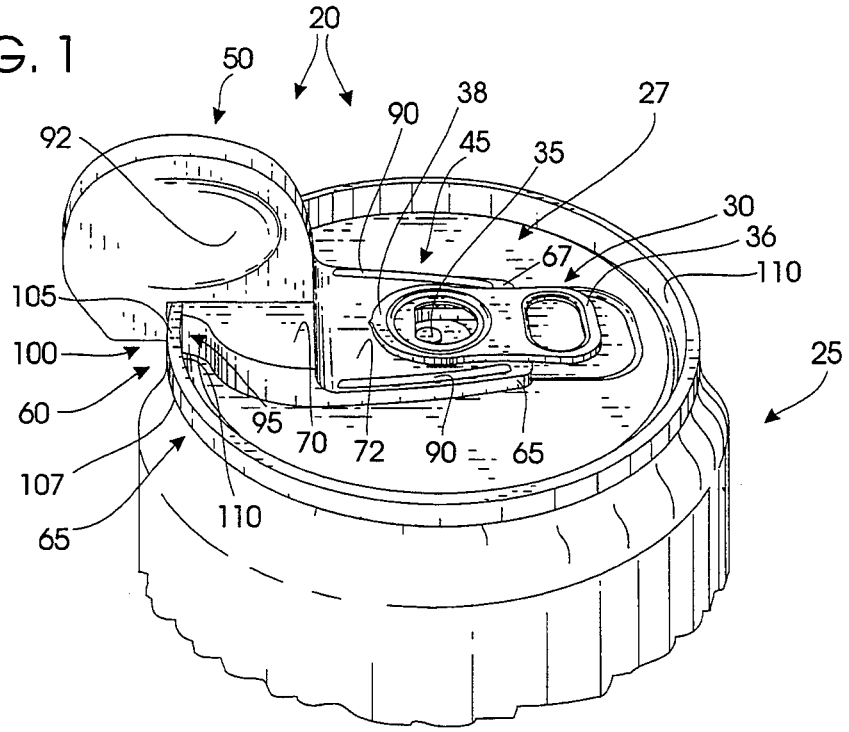
FIG. 1 is an enlarged, partially fragmented, isometric environmental view illustrating my Beverage Can Closure installed on a pry tab can.
Figure 2:
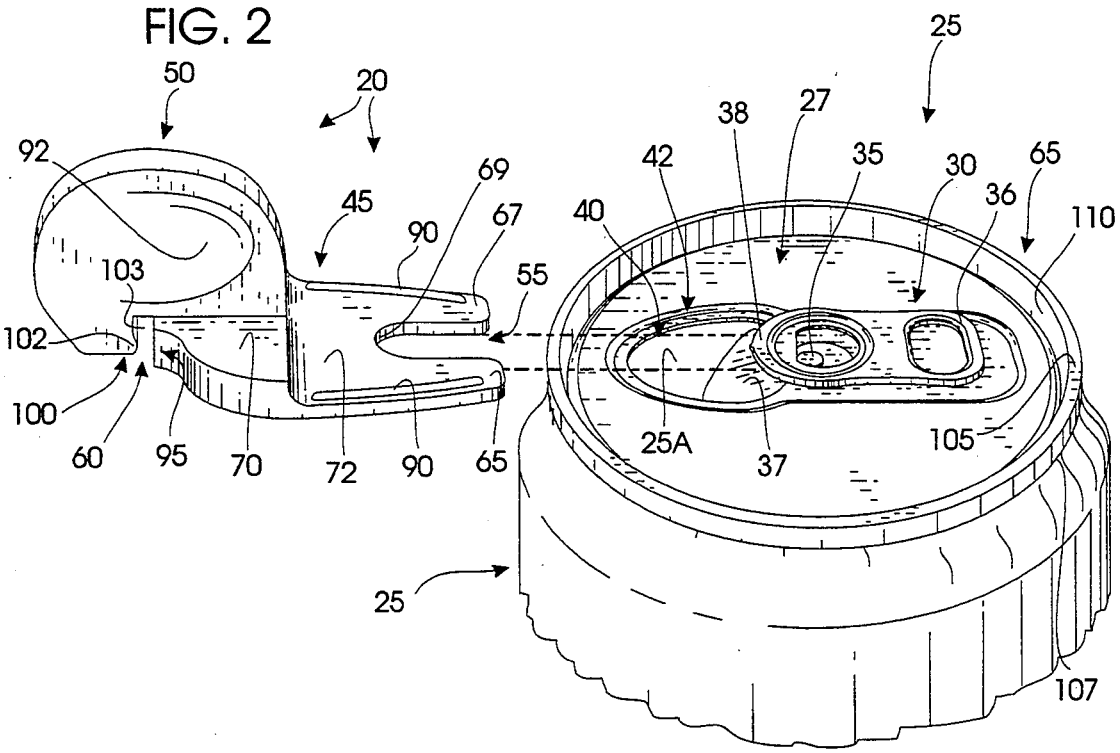
FIG. 2 is an enlarged, partially fragmented, isometric environmental view of my closure and a pry tab can on which it is to be installed.
Figure 3:
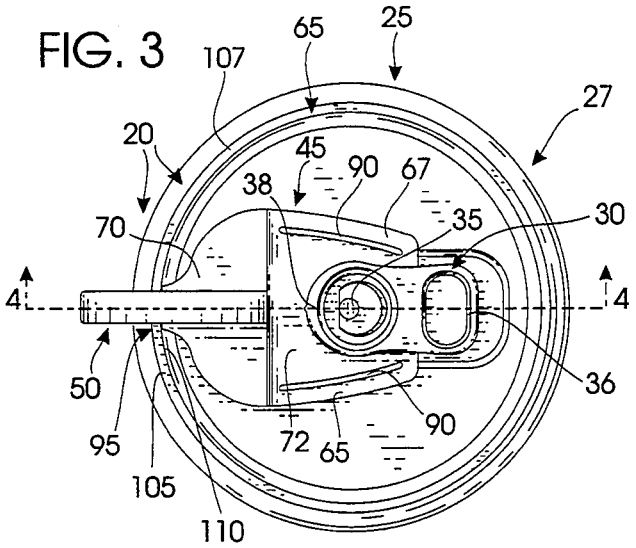
FIG. 3 is an enlarged top plan view of my closure installed on a pry tab can.

With attention now directed to the accompanying drawings, my Beverage Can Closure is broadly designated by the reference numeral 20. The closure 20 is adapted for use with conventional pry tab cans 25 (FIGS. 1–4). With my device, an opened but unemptied pry-tab can may be conveniently resealed for storage.

Typical cans 25 employ an end construction 27 including a pry tab 30 that is pivotally mounted to the can top 27 by a rivet 35. A deflectable region 37 is scored in the top 27 of the can 25. To open the can, handle 36 of the pry tab 30 may be manually deflected upwardly, leveraging the prong end 38 into forcible contact with deflectable scored area 37. The rivet 35 forms a fulcrum for the handle. The scored region 37 deflects after breaking and bends inwardly into the interior 25A of the can 25 to expose a discharge opening. These types of cans often employ reinforcement ridges and indentations such as a channel 42 surrounding the region 37 to reinforce the can end and facilitate score breakage.

My modular closure 20 is preferably constructed of a resilient material such as plastic. As will become apparent below, some deformation of the material is desirable during use. However, it is necessary that the plastic have sufficient "memory" to return to its original shape to facilitate proper continued use. Preferably closure 20 comprises a handle 50 perpendicularly, upwardly extending from a generally horizontally disposed body 45. A frontal notch 55 is defined in the body 45 to mate with the rivet 35 retaining the pry tab 30. The rivet shank will be cleared by notch 55 as the body wedges underneath the pry tab 30. A snap fit 60 is disposed at the rear of the body 45 to mate with the rim 65 of the can 25 to firmly, releasably hold the closure 20 in place.

The body 45 is shaped somewhat like an oval. A front notch 55 is defined between two forwardly extending tongues 65, 67. During installation, a tongue passes on each side of the tab rivet 35. A travel limiting saddle 69 is defined between the tongues 65, 67. The integral handle 50 extends upwardly from the dorsal surface 72 of the body 45. A tapered shoulder 70 is defined in the body 45 to reinforces the juncture of the handle 50 and the body 45.

Figure 11:
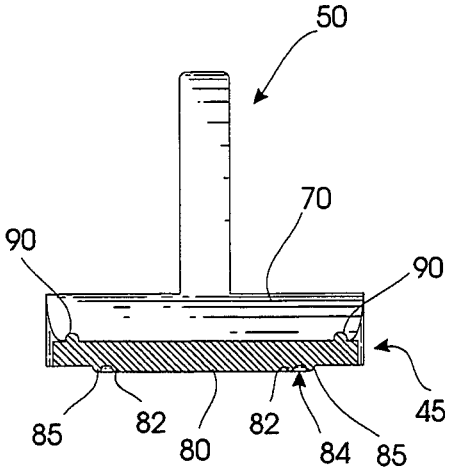
FIG. 11 is an enlarged cross section taken generally along line 11—11 of FIG. 9; and, FIG. 12 is a greatly enlarged fragmentary sectional view of the lower right portion of FIG. 11.
Figure 12:
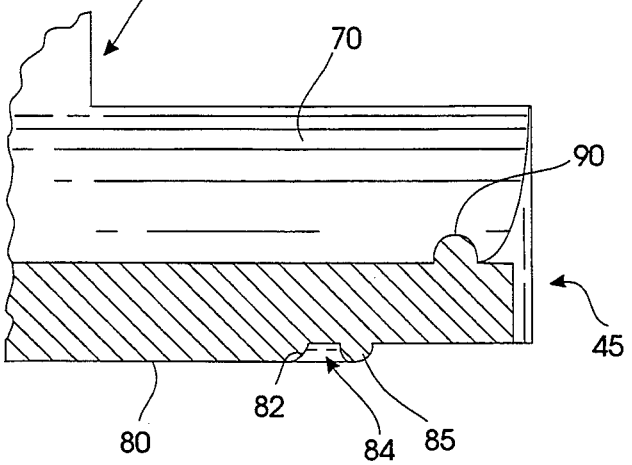

On the opposite, ventral surface 75 an offset 80 extends downwardly. The offset 80 mates with the exposed opening 40 (FIG. 4) in the can top 27. Preferably, the edges 82 of the offset 80 are beveled (FIGS. 11, 12) to facilitate mating with a variety of can opening sizes and configurations. Preferably, an outer circumferential ridge 85 at least partially circumscribes the offset 80. An annular groove 84 separates tapered offset edge 82 from ridge 85. Ridge 85 contacts can top 27 to facilitate sealing. Alternatively, ridge 85 can mate with a channel 42 surrounding the scored region 37 in some can tops 27. The ridge 85 extends on either side of the notch 55 along the ventral surface of each tongue 65, 67.

Preferably, a pair of raised guides 90 are defined in the dorsal surface of the body 45. These raised guides 90 extend along the outer edge of the body 45 to guide the closure 20 into position as it is inserted under the pry tab 30. In other words, the raised guides 90 contact lateral edges of the pry tab 30 during insertion to prevent the closure 20 slipping from side to side.

The handle 50 extends perpendicularly from the body 45. In its' preferred, illustrated form, it defines a grip pad having indented gripper areas 92 in its sides. Alternatively, it could be a ring or horizontally oriented tab.

The snap fit 60 is preferably defined in the body beneath the handle, generally at the rear of the closure. It contacts and mates with the rim 65 of the can 25 to hold the closure in place. The snap fit 60 yieldably clenches the rim 65 to hold the closure 20 in contact with the can top 27 once the tongues 65, 67 are wedged between the tab 30 and the can top 27. In the preferred embodiment the snap fit 60 comprises a stop 95 extending rearwardly from the body 45 and a generally "L" shaped jaw 100 extending from the handle 50. If another handle configuration is employed, the stop 95 and jaw 100 may be integral with the body. The stop 95 extends rearwardly to contact the inner surface 110 of the rim 65. The stop 95 is spaced apart from the notch 55 a distance slightly less than the distance between the rivet 35 and the rim 65 common to the end construction of most cans 25. The horizontally extending portion 102 of the jaw 100 extends to a close proximity with the stop 95.

A rim-receptive slot 103 narrower than the rim 65 is defined between the jaw 100 and the stop 95. As the snap-fit 60 is inserted over the rim 65 of the can 25, the jaw 100 is deflected rearwardly. Once the horizontal leg 102 of the jaw 100 passes below the enlarged portion 105 of the rim 65, it snaps back into close proximity with the stop 95. The thinner wall portion 107 of the rim 65 remains interposed between the stop 95 and the jaw leg 102.

OPERATION

Figure 4:
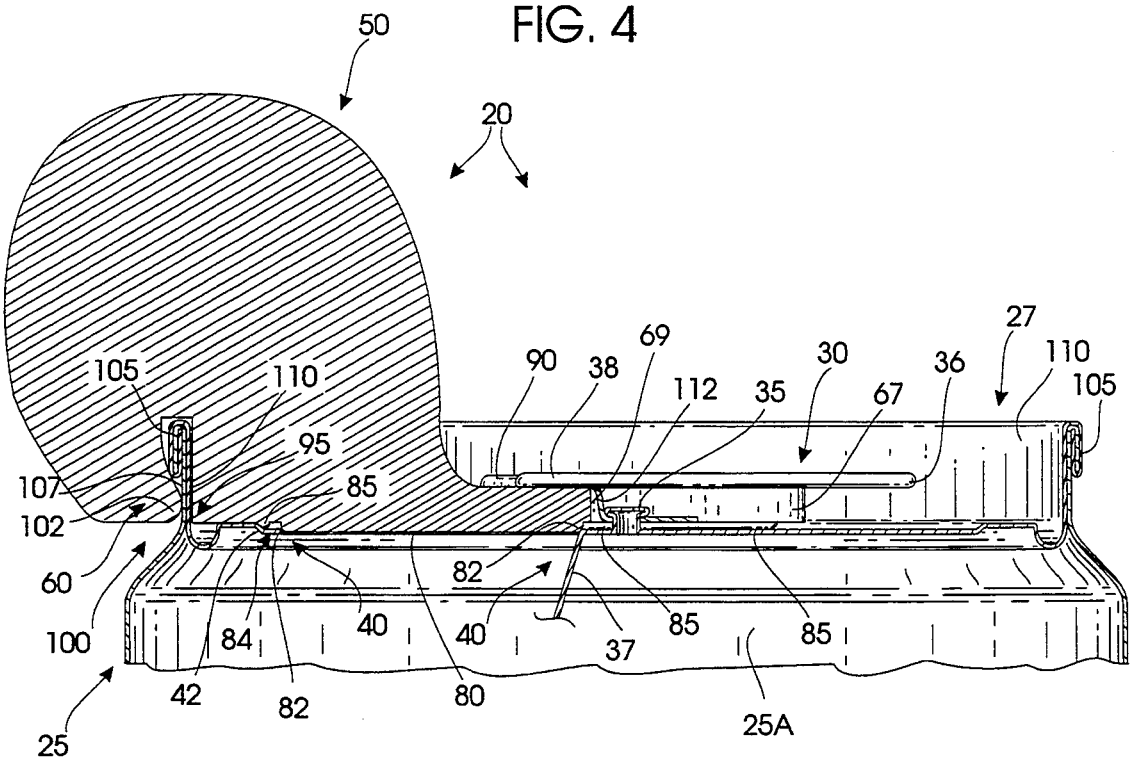
FIG. 4 is an enlarged, partially fragmented cross sectional view taken generally along line 4—4 of FIG. 3 illustrating sealing contact of my closure with the can top.
Figure 5:
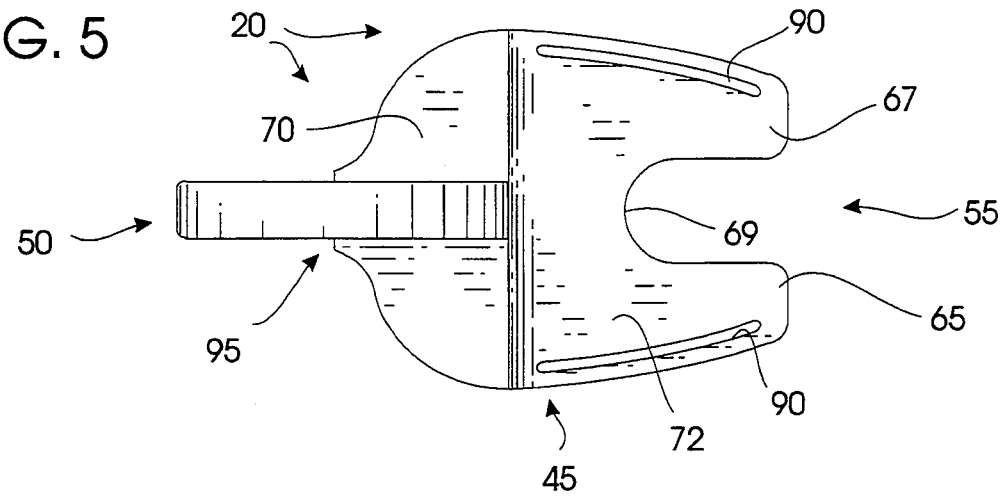
FIG. 5 is an enlarged top plan view of my closure.
Figure 6:
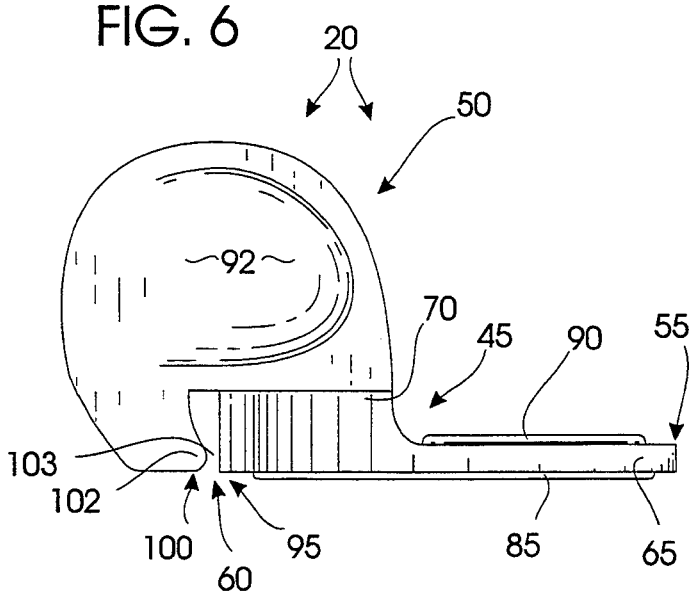
FIG. 6 is an enlarged side elevational view of my closure.
Figure 7:
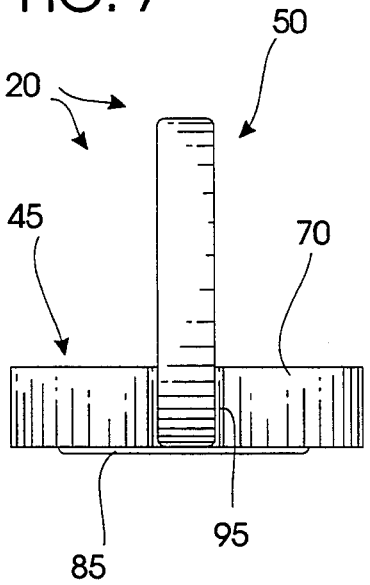
FIG. 7 is an enlarged rear elevational view of my closure.
Figure 8:
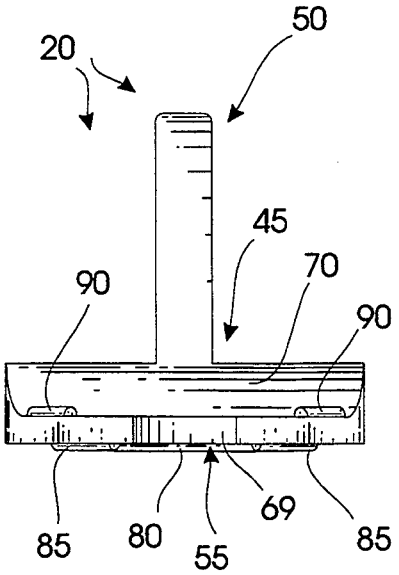
FIG. 8 is an enlarged front elevational view of my closure.
Figure 9:
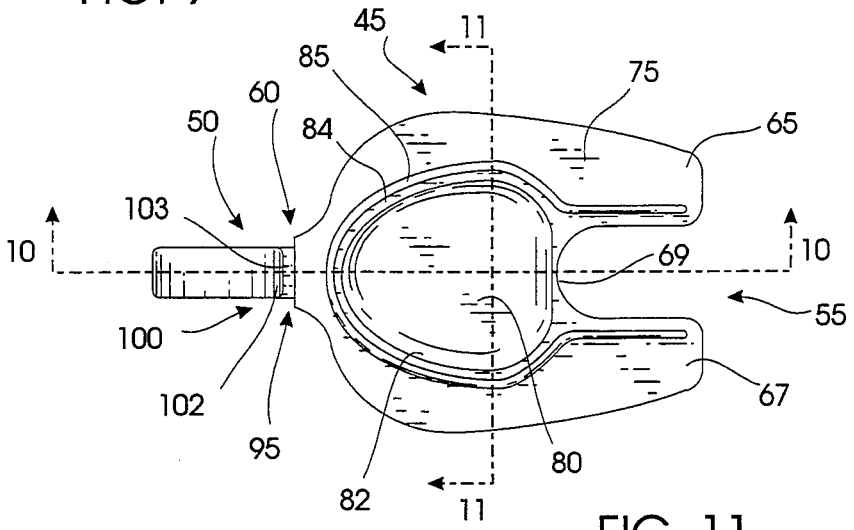
FIG. 9 is an enlarged bottom plan view of my closure.
Figure 10:
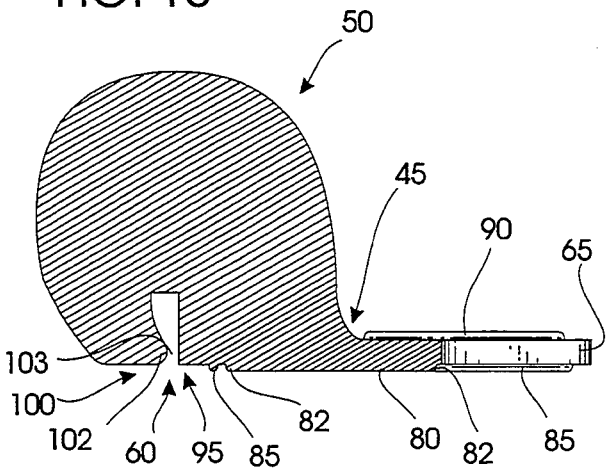
FIG. 10 is an enlarged cross section taken generally along line 10—10 of FIG. 9.

To install my closure 20 one grasps the handle 50 between the thumb and forefinger and slips the tongues 65, 67 of the notch 55 under the pry tab 30, around the rivet 35. The closure is slid toward the pry tab 30 until the snap fit stop 95 clears the inner surface 110 of the rim 65. If the closure 20 is "over inserted" the saddle 69 will contact the metal flap 112 connecting the rivet 35 and the tab 30. To complete installation the handle 50 is pushed downwardly snapping the snap-fit 60 over the rim 65. This forces the offset 80 into engagement with the can opening 40 (FIG. 4). The ventral ridge 85 is forced into sealing contact with the can top 27. Removal is simply the reverse. In other words, the handle 50 is grasped between the thumb and forefinger and pulled upwardly to disengage the snap-fit 60 from the rim 65. Then the tongues 65, 67 are withdrawn from underneath the pry tab 30.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A closure for selectively resealing cans equipped with pry tab openers, said closure comprising:

elongated body means for contacting and sealing an exposed opening in a top of said can, said body means comprising:

a pair of forwardly projecting, tapered tongues adapted to be wedged beneath the pry tab as said closure is installed;

a rivet clearance notch defined between said tongues; and, said notch interiorly terminating in a saddle extending arcuately between said tongues for sealingly contacting the pry tab fastening rivet when the body means is installed to limit closure travel and aid in sealing the can;

handle means extending integrally from said body means for facilitating gripping by a user;

captivating means for yieldably snap fitting to a rim of said can when said closure is installed; and, downwardly projecting offset means integral with said body means for mating within said opening exposed by activation of said pry tab for sealing said can.

2. The closure as defined in claim 1 wherein said offset means is surrounded by a beveled ridge for adapting said closure to cans having varying sizes of openings.

3. The closure as defined in claim 1 wherein said offset means is surrounded by a beveled ridge for mating with a channel surrounding said can opening.

4. The closure as defined in claim 1 wherein said body means comprises guide means for captivating said pry tab during installation of said closure.

5. A resilient, removable closure for selectively sealing previously opened pry tab beverage cans, said closure comprising:

handle means extending outwardly from said closure for enabling gripping of said closure by a user;

integral body means controlled by said handle means for wedgeably engaging said pry tab to seal an exposed opening in a top of said can, said body means comprising:

an integral, downwardly projecting offset formed in the bottom of said closure for occupying said opening to seal said can;

a rivet clearance notch for facilitating mating engagement of said body means with said pry tab; a pair of forwardly projecting, tapered tongues defined on opposite sides of said notch adapted to be wedged beneath said pry tab as said closure is installed;

said notch interiorly terminating in a saddle extending arcuately between said tongues for sealingly contacting a pry tab fastening rivet when the body means is installed to limit closure travel and aid in sealing; and, snap fit means for yieldably engaging a rim of said can when said closure is installed.

6. The closure as defined in claim 5 wherein said closure comprises a ridge adapted to contact a top of a beverage can to seal around the opening.

7. The closure as defined in claim 5 wherein said offset is surrounded by a beveled ridge for adapting said closure to cans having varying sizes of openings.

8. The closure as defined in claim 5 wherein said offset is surrounded by a beveled ridge for mating with a channel surrounding said can opening.

9. The closure as defined in claim 5 wherein said body means comprises guide means for captivating said pry tab during installation of said closure.

10. A resilient, removable closure for selectively resealing and reopening pry tab beverage cans, said closure comprising:

handle means integrally extending perpendicularly and rearwardly from said closure for enabling gripping of the closure by a user;

integral body means controlled by said handle means for wedgeably engaging said pry tab to seal an exposed opening in a top of said can, said body means comprising:

an integral, downwardly projecting offset formed in the bottom of said closure for occupying said opening to seal said can;

a rivet clearance notch for facilitating mating engagement of said body means with said pry tab;

a pair of forwardly projecting, tapered tongues defined on opposite sides of said notch adapted to contact the underside of said pry tab as said closure is installed to urge said offset into said exposed opening; and, snap fit means for yieldably engaging a rim of said can when said closure is installed.

11. The closure as defined in claim 10 wherein said snap fit means comprises:

a stop extending rearwardly from said body to contact said rim; and, a slotted jaw extending downwardly from said handle means, a portion of said jaw catching on a lower outer surface of said rim when said closure is forced downwardly against said rim.

* * * * *